US010673179B1

(12) United States Patent
Harris

(10) Patent No.: US 10,673,179 B1
(45) Date of Patent: Jun. 2, 2020

(54) BREAKAWAY ELECTRICAL CONNECTOR SYSTEM

(71) Applicant: Ryan Harris, Willingboro, NJ (US)

(72) Inventor: Ryan Harris, Willingboro, NJ (US)

(73) Assignee: RyDeas, LLC, Henderson, NV (US)

( * ) Notice: Subject to any disclaimer, the term of this patent is extended or adjusted under 35 U.S.C. 154(b) by 64 days.

(21) Appl. No.: 15/972,270

(22) Filed: May 7, 2018

Related U.S. Application Data

(60) Provisional application No. 62/506,148, filed on May 15, 2017.

(51) Int. Cl.

| | |
|---|---|
| ***H01R 13/64*** | (2006.01) |
| ***H01R 13/627*** | (2006.01) |
| ***H01R 13/66*** | (2006.01) |
| ***H01R 4/30*** | (2006.01) |
| ***H01R 13/631*** | (2006.01) |
| ***H01R 4/48*** | (2006.01) |

(52) U.S. Cl.
CPC ..... *H01R 13/6271* (2013.01); *H01R 4/30* (2013.01); *H01R 4/48* (2013.01); *H01R 13/631* (2013.01); *H01R 13/6675* (2013.01); *H01R 13/6683* (2013.01); *H01R 13/6691* (2013.01)

(58) Field of Classification Search
CPC ..... H01R 13/64; H01R 13/465; H01R 13/641
USPC ..... 439/488, 489, 374–375, 378
See application file for complete search history.

(56) References Cited

U.S. PATENT DOCUMENTS

| | | | | |
|---|---|---|---|---|
| 1,665,095 | A * | 4/1928 | Henry | H01R 13/639 439/372 |
| 4,629,272 | A * | 12/1986 | Mattingly | H01R 13/625 439/318 |
| 6,554,626 | B2 * | 4/2003 | Ramos, Jr. | H01R 13/508 439/144 |
| 7,097,514 | B2 * | 8/2006 | Ishizaki | H01R 24/542 439/681 |
| 7,186,130 | B1 * | 3/2007 | Miller | H01R 13/639 439/369 |
| 7,452,233 | B1 * | 11/2008 | Michelsen | H01R 13/6273 439/369 |
| 7,534,124 | B1 * | 5/2009 | Lemaire | H01R 13/193 439/263 |
| 8,070,509 | B2 * | 12/2011 | Luzzi | H01R 13/639 439/489 |
| 8,328,574 | B1 * | 12/2012 | Lin | H01R 13/6275 439/321 |
| 8,678,850 | B2 * | 3/2014 | Nagasaka | H01R 13/6272 439/364 |

(Continued)

*Primary Examiner* — Abdullah A Riyami
*Assistant Examiner* — Thang H Nguyen
(74) *Attorney, Agent, or Firm* — Joseph E. Maenner; Maenner & Associates, LLC

(57) ABSTRACT

A smart breakaway electrical connector disconnects a powerline at a designed tensile load, detects the break, and wirelessly communicates the precise location of the break to repair dispatchers. Mating male and female housings hold the internal electrical connection points together. Locking arms pivotally connected to the female connector interlock by detent with the male connector and spring force on the locking arms is used to prevent disengagement of the detent until the design tensile force is exceeded. Photovoltaics combined with rechargeable batteries ensure power availability when the line is disconnected and utility power is unavailable.

14 Claims, 7 Drawing Sheets

(56) References Cited

U.S. PATENT DOCUMENTS

| | | | | |
|---|---|---|---|---|
| 8,690,595 | B2 * | 4/2014 | Barna | H01H 85/0241 439/352 |
| 8,747,166 | B2 * | 6/2014 | Yamada | H01R 13/64 439/680 |
| 9,194,160 | B1 * | 11/2015 | Kelsch | H01R 13/6205 |
| 9,203,183 | B2 * | 12/2015 | Konchan | H01R 13/703 |
| 9,368,911 | B2 * | 6/2016 | Charnesky | H01R 13/639 |
| 9,437,972 | B2 * | 9/2016 | Endo | H01R 13/6315 |
| 10,096,943 | B2 * | 10/2018 | Archuleta | H01R 13/639 |
| 10,128,613 | B2 * | 11/2018 | Yang | H01R 13/631 |
| 10,483,690 | B1 * | 11/2019 | Stanfield | H01R 13/111 |
| 2013/0137292 | A1 * | 5/2013 | Abuelsaad | H01R 4/64 439/488 |
| 2014/0193998 | A1 * | 7/2014 | Zomchek | H01R 31/005 439/488 |
| 2015/0002296 | A1 * | 1/2015 | Bell | G06F 1/1632 340/540 |

* cited by examiner

BREAKAWAY ELECTRICAL CONNECTOR SYSTEM

CROSS-REFERENCE TO RELATED APPLICATION

The present application claims priority from U.S. Provisional patent Application Ser. No. 62/506,148, filed on May 15, 2015, which is incorporated herein by reference in its entirety.

BACKGROUND OF THE INVENTION

Field of the Invention

The present invention relates to the safety and reporting of downed power lines.

Description of the Related Art

Broken overhead power lines are a safety hazard and a financial burden worldwide. Nationally, about 300 deaths occur annually due to broken overhead power lines. In addition to being a safety hazard, a broken line can cost up to $1,000,000+ per hour in damages and repairs. On an international scale there are relatively few systems that do not have exposed wires or are fitted with a modern local monitoring system. With advances in materials, communications, and general technology it is now possible to improve these outdated systems.

Current monitoring systems used in large scale public applications do not monitor local power distribution status (within 0.5 miles). Most of the systems used are monitored at main distribution junctions or power distribution hubs. These systems require maintenance crews to search for the problem over a certain radius rather than go directly to the problem source. In many cases power outages are reported by 911 calls.

It would be beneficial to have a device at each utility pole that provides a predetermined breakaway location, while also providing a reporting function to immediately inform repair personnel as to the precise location for dispatching purposes.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is a breakaway connector that can be implemented into new systems, or retrofitted to existing power distribution systems. The system includes a tension release mechanism connected directly to the power line that uses a wireless communication system to monitor system function. When an outside element such as a falling tree lands on the power line, the tension release mechanism disconnects the overhead line and a wireless control module notifies the power supply company that there has been a disturbance in the system. This system will protect the surrounding areas from high voltage shock and ensure that the power company is immediately notified that line is down. This system can be implemented world-wide and has the potential to save lives and decrease financial losses.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION

Figure 1:
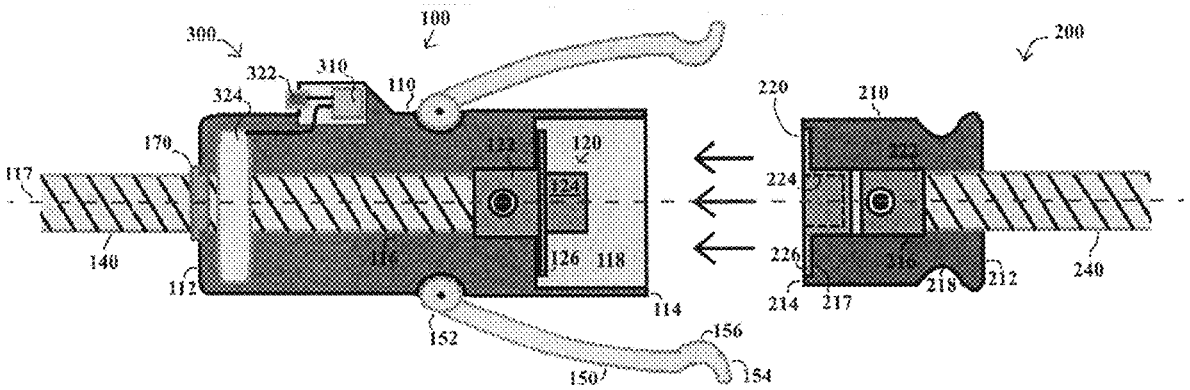
FIG. 1 is an exploded cross-sectional view of a locking mechanism according to a first exemplary embodiment of the present invention.

In the drawings, like numerals indicate like elements throughout. Certain terminology is used herein for convenience only and is not to be taken as a limitation on the present invention. The terminology includes the words specifically mentioned, derivatives thereof and words of similar import. As used herein, the term "distal" is defined as a distance away from a connection of male and female housing parts and the term "proximal" is defined as a distance close to the connection of the male and female housing parts.

The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of Figure numbers and/or Figure reference labels in the claims is intended to identify one or more possible embodiments of the claimed subject matter in order to facilitate the interpretation of the claims. Such use is not to be construed as necessarily limiting the scope of those claims to the embodiments shown in the corresponding Figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

One mechanical problem with overhead power line systems is that the systems are exposed to dynamic forces, but most systems are designed to operate as stationary systems; that is, if a tree or large object falls on an overhanging line, the line or post will most likely break from the system violently. When the line or pole breaks, it is likely that the system still has high voltage and current flowing through it, thus being an immediate danger to its surrounding environment.

To solve the problem mechanically, a releasable connector 190 ("connector 190") according to an exemplary embodiment is provided and is shown in FIGS. 1-6. The connector 190 is an electrical connector that releases under a set tensile load. The connector 190 is connected directly in line with the system primary wire. The connector 190 can be retrofitted to existing systems or applied during new construction. The connector 190 includes a lock that operates under a spring load. In normal conditions the connector 190 has the ability to withstand external elemental forces such as weathering, light loads (such as birds and other small animals), and torsion. When the connector 190 experiences high external tensile loads, the spring lock will expand causing the housing to release and separate into two parts. This generates a controlled break in the line. The break immediately disconnects power to the line, which then falls innocuously to the ground. By having a controlled breaking point in the line, the chance of electric shock and extended system damage is greatly reduced.

Figure 2:
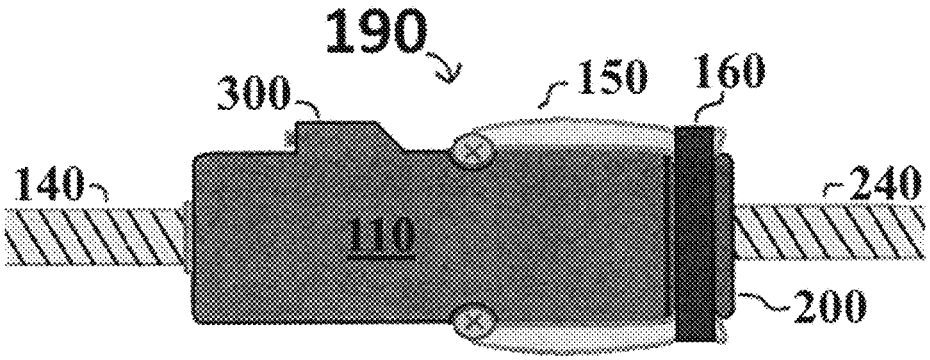
FIG. 2 is a side elevational view of the locking mechanism of FIG. 1.

Referring specifically to FIGS. 1 and 2, connector 190 is shown cross-sectionally and externally (respectively). Connector 190 includes a female connector 100 and a male connector 200 joined together.

Figure 3:
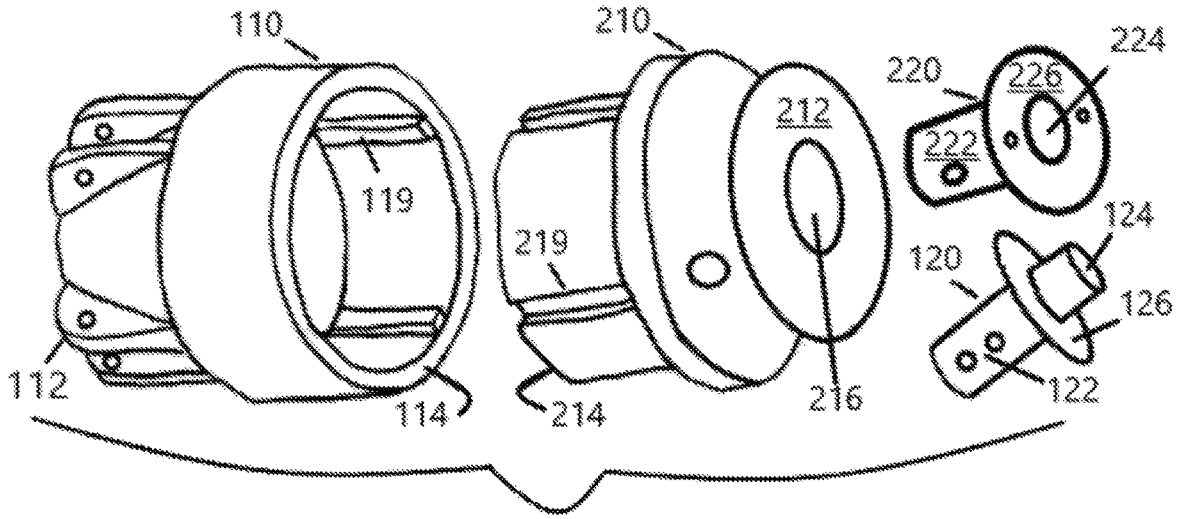
FIG. 3 is an exploded perspective view of the components of the locking mechanism of FIG. 1.

The female connector 100 includes a female housing 110 formed with a female housing passage 116 extending along a central longitudinal axis 117 of the connector 190. The female housing 110 has a distal end 112 and a proximal end 114. The proximal end 114 of the female housing 110 is formed with a cavity 118 centered on the female housing passage 116. At least one spline 119 is formed on the inside of the cavity 118 parallel to the longitudinal axis 117. In an exemplary embodiment, as shown in FIG. 3, four splines 119 are spaced ninety degrees apart from each other inside the cavity 118, although those skilled in the art will recognize that more or less than four splines 119 can be used.

A female contact 120 is includes a female hollow cylindrical protrusion 122 and a solid protrusion 124 separated by a female contact lip 126 formed circumferentially around the female contact 120. The female hollow cylindrical protrusion 122 is inserted into the proximal end 114 of the female housing passage 116. The movement of the female contact 120 into the female housing passage 116 is limited by the female contact lip 126, leaving the solid protrusion 124 extending away from the proximal end 114 of the female housing passage 116.

A first electrical cable 140 is inserted into the female housing passage 116 at the distal end 112 of the female housing 110 and inserted into the female hollow cylindrical protrusion 122 where the cable 140 is fixedly connected to the female contact 120. Those skilled in the art will recognize that different types of connections can be provided, such as, for example, the insertion of a threaded connector (not shown) through the side of the female housing 110 to wedge the cable 140 against the inside wall of the female housing 110, although other types of connections are contemplated.

The male connector 200 includes a male housing 210, with a male housing proximal end 214 and a male housing distal end 212, the proximal end 214 being sized to fit into the cavity 118 at the proximal end 114 of the female housing 110 so that the male connector 200 can be inserted into the cavity 118 of the female housing 110. The male housing 210 is formed with a male housing passage 216 along the longitudinal axis 117. The proximal end 214 includes a shoulder 217 formed therein.

The male housing 200 is longer than the depth of the cavity 118, and a detent receiver 218 is formed into the outer circumference of the male housing 200 near the distal end 212 of the male housing 210 so that the detent receiver 218 is exposed when the male connector 200 is fully inserted into the cavity 118 of the female connector 100. At least one spline groove 219 is formed on the outside of the male housing 210 parallel to the longitudinal axis 117. The number, shape, and placement of spline grooves 219 is to match the splines 119 wherein the splines 119 and spline grooves 219 interlock when the connector 190 is in its locked position to prevent the female housing 110 from rotating around the longitudinal axis 117 relative to the male housing 210.

A male contact 220 has a male lip 226, formed with a male contact hole 224 at the center and sized to be retained by the shoulder 217, and a male hollow cylindrical protrusion 222 at a distal end of the male contact 220. The second electrical cable 240 enters the male housing passage 216 at the distal end 212, passes through the male housing passage 216, enters the male hollow cylindrical protrusion 222 and is fixedly attached to the male contact 220 in the same manner as described above with respect to the connection of the first cable 140 with the female housing 110. Tension on the second electrical cable 240 pulls the male contact 220 into the male housing passage 216 until the male lip 226 meets the proximal end 214 of the male housing 200.

The male connector 200 is releasably inserted into the cavity 118 of the female connector 100. All geometries are matched such that the female contact lip 126 mates with the male lip 226 and so that the solid protrusion 124 mates with the male contact hole 224.

The female contact 120 and the male contact 220 are constructed from an electrically conductive material, thus establishing an electrical connection between the first electrical cable 140 and the second electrical cable 240 when the male connector 200 is fully inserted into the female connector 100.

Figure 4:
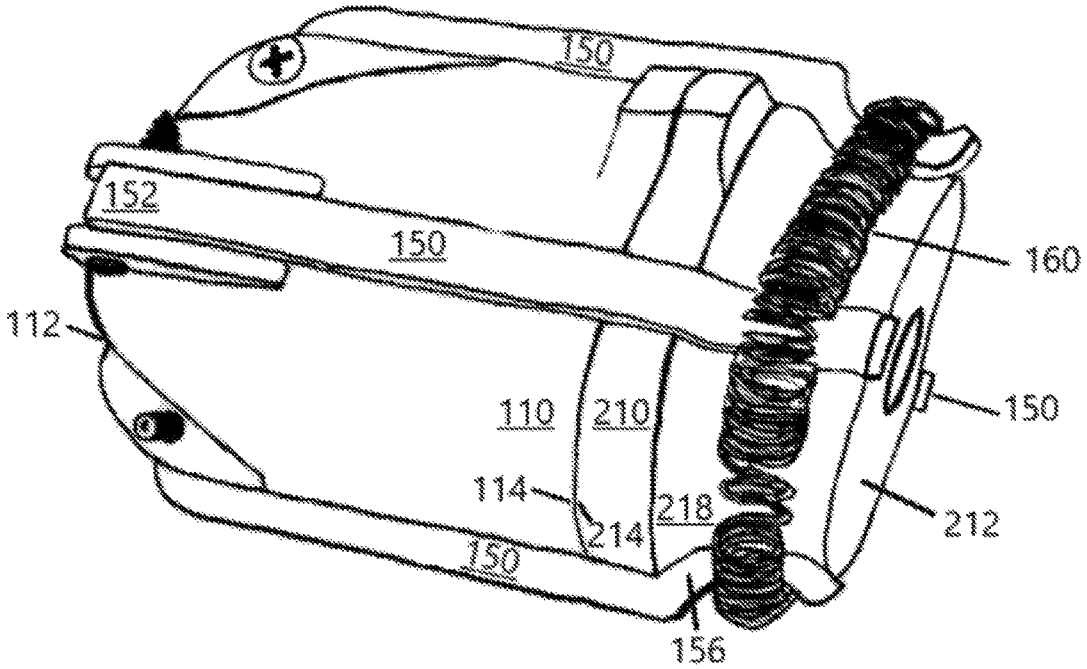
FIG. 4 is a perspective view of the locking mechanism of FIG. 1.

The female connector 100 further includes at least one locking arm 150 with a pivot end 152 pivotally connected to the female housing 110 and a detent end 154 formed with a detent 156 adapted to releasably engage the detent receiver 218 formed into the male housing 210. In an exemplary embodiment, as shown in FIG. 4, four locking arms 150 are spaced ninety degrees apart from each other around the periphery of the female housing 110, although those skilled in the art will recognize that more or less than four locking arms 150 can be used.

Once the female connector 100 and male connector 200 are fully engaged, the locking arm 150 is pivoted to engage the detent 156 with the detent receiver 218. A biasing member 160, such as for example a helical spring, is placed around the connector 190 over the detents 156 in each locking arm 150 to bias each detent 156 forcefully into its respective detent receiver 218. This biasing force resists separation of the male connector 200 from the female connector 100 by tensile forces on the electrical cables 140, 240. Resistance to separation can be increased by using a stronger biasing member 160, increasing the number of locking arms 150, and increasing the aggressiveness of the detents 218. Conversely, resistance to separation can be decreased by using a weaker biasing member 160, decreasing the number of locking arms 150, and decreasing the aggressiveness of the detents 218.

Once the tensile force on the electrical cables 140, 240 overcomes the resistance and the connector 190 begins to separate, the detent 156 loses engagement with the detent receiver 218 and the resistance to separation is nearly eliminated, allowing the female connector 100 to separate entirely from the male connector 200. This breakaway action breaks the electrical connection between the first electrical cable 140 and the second electrical cable 240, reducing the risk of injury and property damage due to contact with downed wires.

The electrical problems stem from creating a local monitoring system. To reduce down time the system must be able to communicate wirelessly. This is accomplished by implementing control modules with real time monitors and wireless capabilities. Control modules and other electronic devices require a power source. This system is designed to operate when the loss of power occurs; therefore an alternate power source must be provided.

Figure 6:
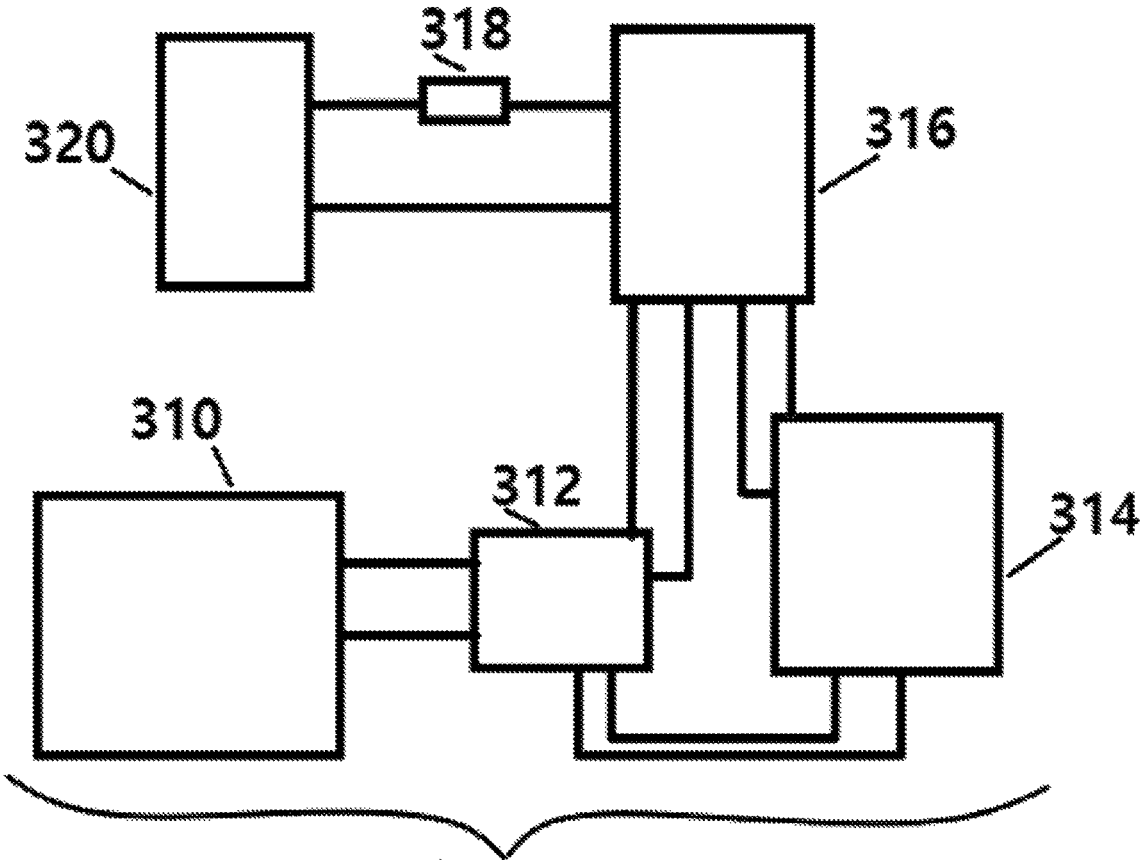
FIG. 6 is a schematic view of a power management system used with the locking mechanism of FIG. 1.

The female connector 100 also includes a controller 300. The controller 300 serves monitoring, communication, and power management functions. Referring to FIG. 6, a schematic is shown for power management functions of the controller 300. A solar charging controller 316 receives power from a photovoltaic panel 320 through a diode 318 to prevent backflow of power when light is not energizing the photovoltaic panel 320. While solar power is available, the solar charging controller 316 charges a rechargeable battery 314 and supplies power to a DC/DC converter 312. While solar power is not available, the battery 314 supplies power to the DC/DC converter 312. The DC/DC converter 312 supplies power to a computer 310. The photovoltaic panel 320 and batteries 314 allow the controller 300 to function independent of any short or long term power outage in the local power grid.

Figure 5:
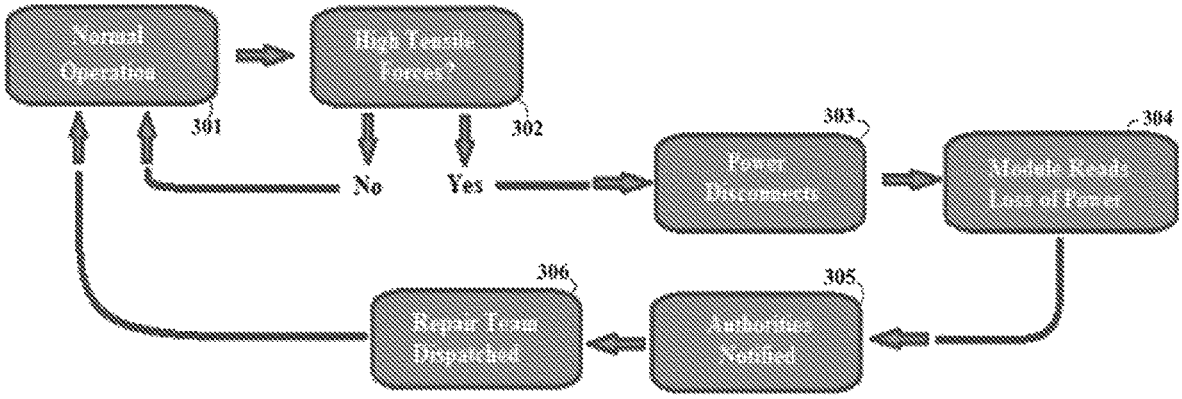
FIG. 5 is a flow chart showing the use of the locking mechanism of FIG. 1 in an electrical system.

Referring to FIG. 5, a flowchart shows the role of the connector 190 in repairing damaged power lines. The connector 190 begins in normal operation mode represented by a first flow chart box 301. While the connector 190 is not experiencing high tensile forces, the connector remains in normal operation mode as represented by a second flow chart box 302 returning circularly to the first flow chart box 301. If the connector 190 experiences high tensile forces then the connector 190 separates and disconnects the power, as represented by movement from the second flow chart box 302 to a third flow chart box 303. When electrical connectivity is lost, an amp transducer 324 (shown in FIG. 1) sends a signal to the computer 310 (shown in FIG. 6), and the computer 310 registers a loss of power as represented by movement from the third flow chart box 303 to a fourth flow chart box 304. Once the controller 300 detects the loss of power, the controller 300 sends a signal to a wireless transmitter 322 (shown in FIG. 1) and the transmitter 322 alerts authorities to the location where repairs are needed, as represented by movement from the fourth flow chart box 304 to a fifth flowchart box 305. Having prompt notification, authorities can dispatch repair teams as represented by movement from the fifth flowchart box 305 to a sixth flow chart box 306. Once repair teams have completed necessary repairs, the connector 190 returns to normal operation as represented by movement from the sixth flowchart box 306 to the first flowchart box 301.

The female connector also includes a weather seal 170 around the first electrical cable 140 in contact with the female housing 110 whereby water and dust cannot migrate into the female housing 110 and interfere with operation of the amp transducer 324.

Referring specifically to FIGS. 7-10, connector 590 is shown as a second embodiment of the present invention both externally and in cross section.

Figure 7:
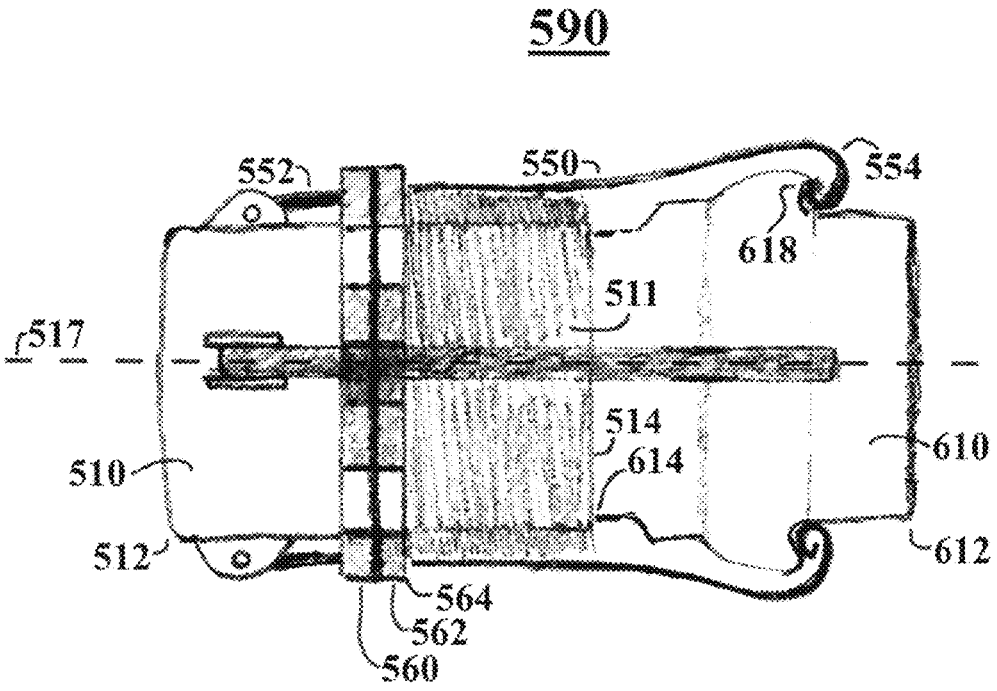
FIG. 7 is a side elevational view of a locking mechanism according to a second exemplary embodiment of the present invention.
Figure 8A:
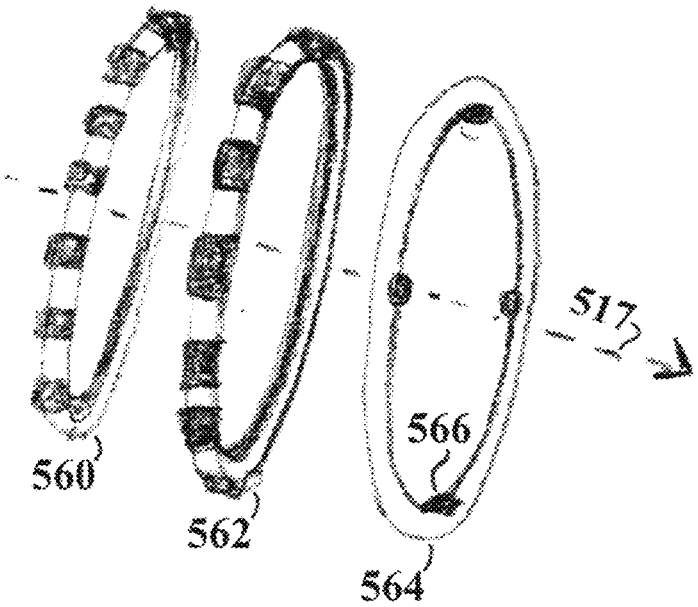
FIG. 8A is an exploded perspective view of the nuts and spring guide components of the locking mechanism of FIG. 7.
Figure 8B:
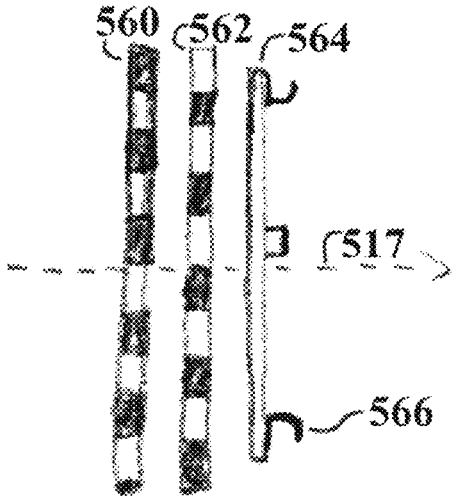
FIG. 8B is an exploded side elevational view of the nuts and spring guide components of the locking mechanism of FIG. 7.
Figure 9:
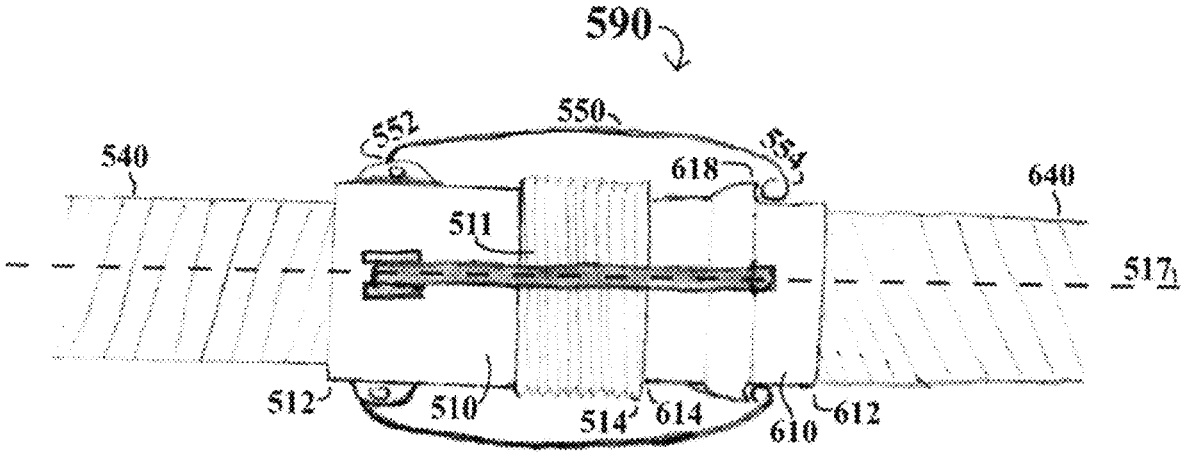
FIG. 9 is a side elevational view of the locking mechanism of FIG. 7 with the nuts and spring guide omitted.
Figure 10:
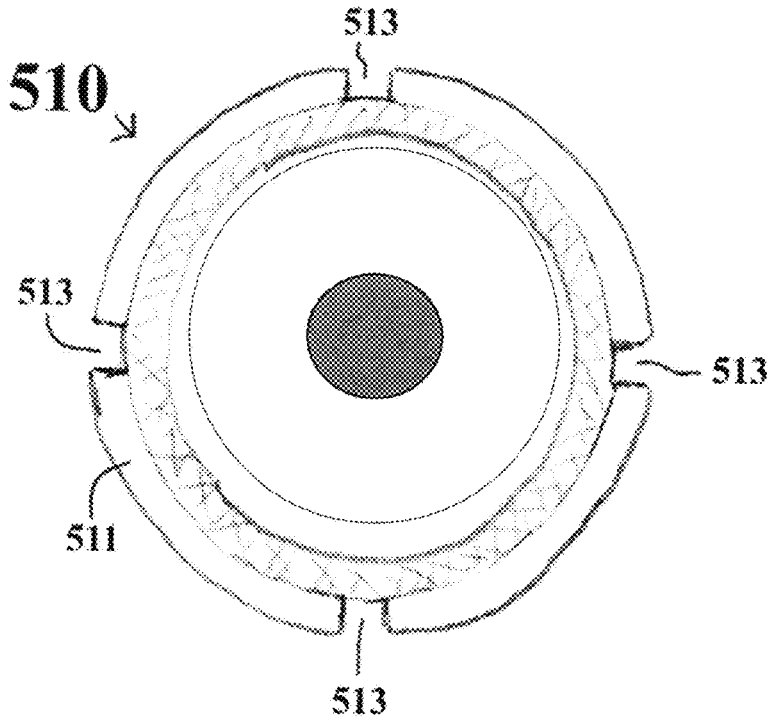
FIG. 10 is an axial cross sectional view of the female housing of the locking mechanism of FIG. 7 showing the threaded area and grooves of the female housing.
Figure 11:
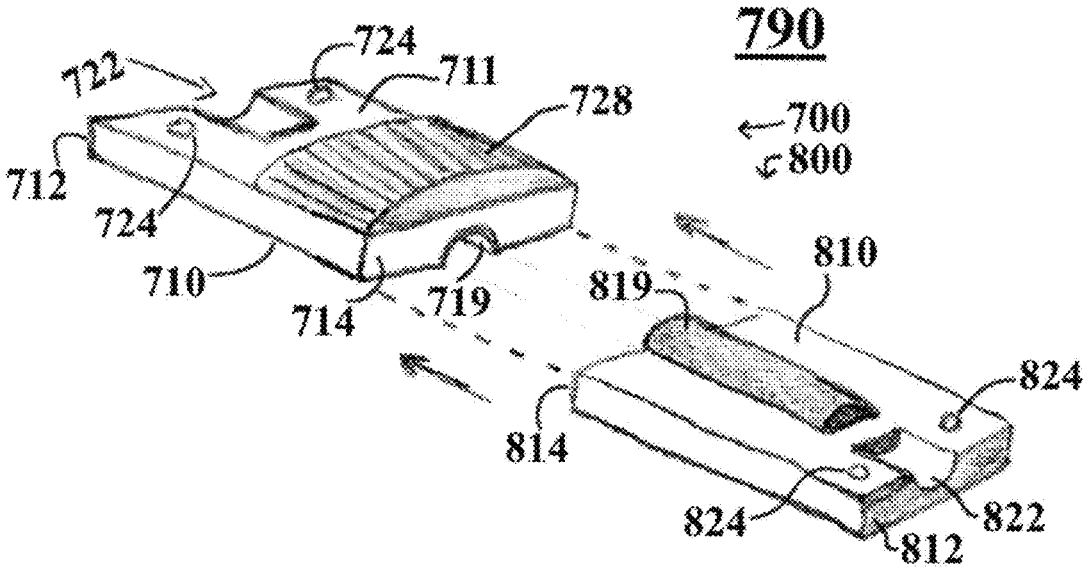
FIG. 11 is a perspective view, of the male and female contacts according to an alternative exemplary embodiment of the electrical contacts housed within the connector system of FIG. 1.
Figure 12:
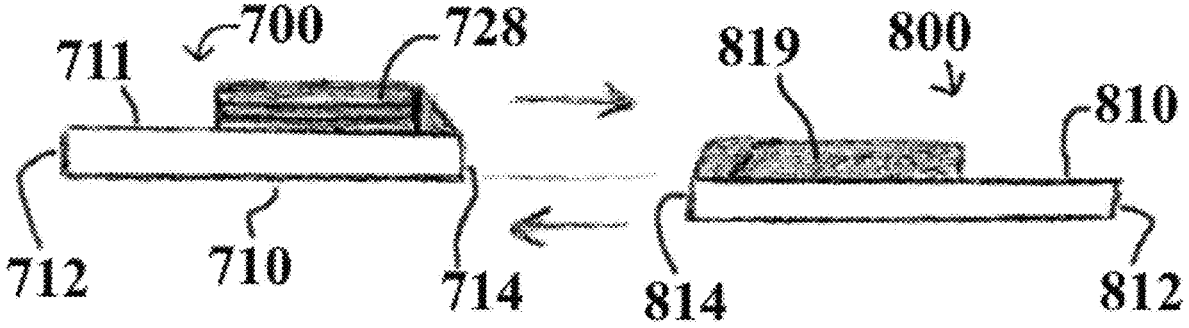
FIG. 12 is a side elevational view of the male and female contacts of FIG. 11.
Figure 13A:
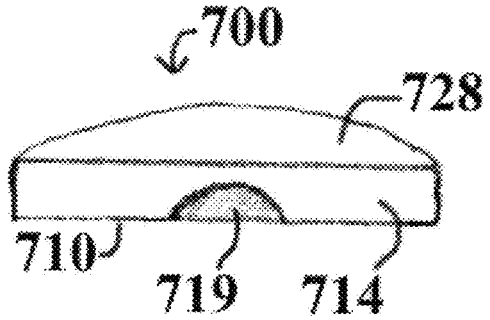
FIG. 13A is an end elevational view of the female contact of FIG. 11.
Figure 13B:
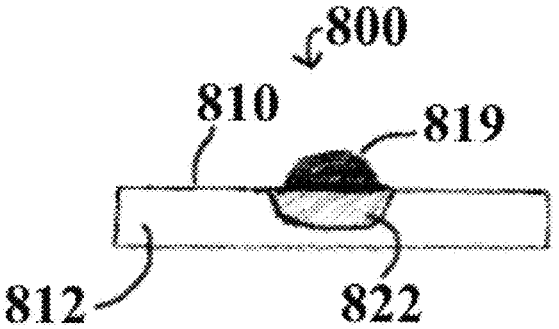
FIG. 13B is an end elevational view of the male contact of FIG. 11.

Connector 590 includes a hollow cylindrical female housing 510 and a male housing 610, locked together by at least one locking arm 550. In an exemplary embodiment, as shown in FIGS. 7 and 9, three locking arms 550 are visible, with a fourth hidden, spaced ninety degrees apart from each other around the outer periphery of the female housing 510. Those skilled in the art will recognize that more or less than four locking arms 550 can be used.

The female housing 510 extends along a longitudinal axis 517. The female housing 510 includes a female housing proximal end 514, a female housing distal end 512, and a threaded area 511 formed circumferentially around the outer periphery of the proximal end 514. The threaded area 511 further includes at least one groove 513 for each locking arm 550. Each groove 513 extends parallel to the longitudinal axis 517 and has a depth exceeding the sum of the height of the threaded area 511 plus the thickness of the locking arms 550. The grooves 513 are spaced around the outer periphery of the female housing 510 in alignment with the locking arms 550 whereby the locking arms 550 enter the grooves 513 when the locking arms 550 are pivoted all the way toward the female housing proximal end 514.

The male housing 610 also extends along the longitudinal axis 517. The male housing 610 has a male housing proximal end 614 and a male housing distal end 612. The proximal end 614 is sized to releasably insert into the female housing proximal end 514. The distal end 612 has a circumferential lip 618 formed around the outer periphery thereof. The lip 618 remains exposed when the male housing 610 is fully inserted into the female housing 510.

Each locking arm 550 has a first end 552 pivotally connected to the female housing 510 near the distal end 512. The locking arm 550 has a second end 554 sized to releasably engage the lip 618. The second end 554 is curled inwardly as shown in FIGS. 7 and 9. Each locking 550 arm is constructed of flat spring material or other suitable, resilient material. When the locking arms 550 are engaged with the lip 618, the engagement resists separation of the male housing 610 from the female housing 510. When an axial force of separation exceeds the resistance, the locking arms 550 disengage from the lip 618 and all resistance to separation is eliminated, allowing the male housing 610 to freely separate from the female housing 510.

Connector 590 further includes means for setting a predetermined resistance to separation of the male housing 610 from the female housing 510. In an exemplary embodiment, a first lock nut 562 and a second lock nut 560 are used. The first lock nut 562 threads onto the threaded section 511 with the locking arms 550 biased into the grooves 513 by the first lock nut 562. When the male housing 610 is fully inserted into the female housing 510, the first lock nut 562 also biases the second end 554 of the locking arm 550 into engagement with the lip 618. As the first lock nut 562 is threaded farther toward the female housing proximal end 514, the second end 554 of the locking arm 550 is biased more into the lip 618, producing greater resistance to separation, thereby predetermining the tension at which the male connector 610 separates from the female connector 510.

The second lock nut 560 is threaded onto the threaded area 511 located distal to the first lock nut 562. The second lock nut 560 is tightened against the first lock nut 562 whereby both lock nuts 560, 562 are locked in place by friction against each other.

Connector 590 further includes a spring guide 564 sized to slide over the threaded area 511. The spring guide 564 has a tab 566 for each locking arm 550. Each tab 566 is shaped and spaced to fit into the grooves 513. Each tab 566 points into the grooves 513 and is bent radially outwardly. The tabs 566 extend partially into the grooves 513 whereby the tabs 566 contact the locking arms 550 and bias the locking arms 550 into the respective grooves 513 to prevent contact between each locking arm 550 and the nuts 560, 562.

Referring specifically to FIGS. 11-14B, an alternative exemplary embodiment of a contact system 790 is shown. System 790 includes a female contact 700, a male contact 800, and separate means for attaching the first cable 140 (shown in FIG. 1) to the female contact 700 and attaching the second cable 240 (shown in FIG. 1) to the male contact 800. The female contact 700 is an alternative embodiment to the female contact 120 retained within the female housing 110, and the male contact 800 is an alternative to the male contact 220 retained within the male housing 210.

The female contact 700 is constructed of an electrically conductive material and includes a generally flat female face 710 and a keyway 719 formed in the female face 710 extending from a female contact proximal end 714, partially toward a female contact distal end 712. The female contact 700 also has a crimp seat 722 formed into a female contact top face 711. The crimp seat 722 extends from the distal end 712 partially toward the proximal end 714. While the crimp seat 722 is shown as being formed in the top face 711, those skilled in the art will recognize that the crimp seat 772 can be formed in the female face 710. The female contact 700 further includes two crimp locator holes 724 formed in the top face 711 on either side of the crimp seat 722. The female contact 700 further includes a protrusion 728 on the top face 711 at the proximal end 714 extending outward from the top face 711. In an exemplary embodiment, the protrusion 728 is curved to accommodate insertion into the female housing 110 (shown in FIG. 1).

The male contact 800 is constructed of an electrically conductive material and includes a generally flat male face 810. A male key 819 formed on the proximal end 814 of the male face 810 extending outwardly from the male face 810. The male key 819 extends partially toward a male contact distal end 812 and is shaped to releasably engage the keyway 719 on the female contact 700.

A male crimp seat 822 is formed in the male face 810 at the distal end 812 and extends partially toward the proximal end 814. Two crimp locator holes 824 are formed in the male face 810, one on either side of the male crimp seat 822.

Figure 14A:
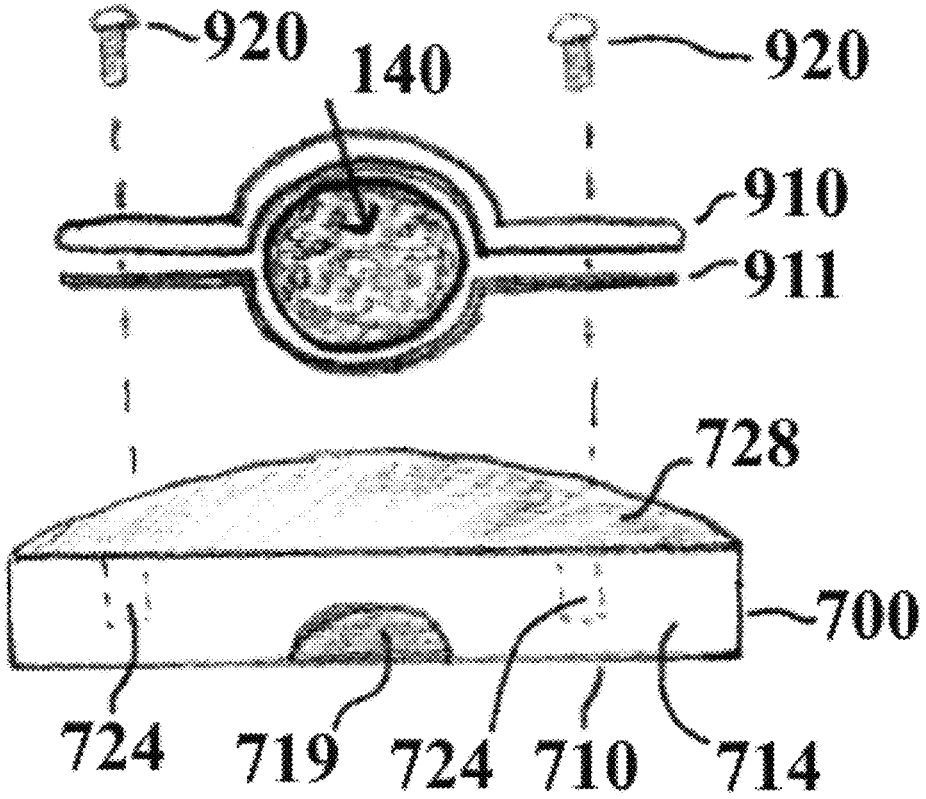
FIG. 14A is an exploded end elevational view of the female contact of FIG. 11.
Figure 14B:
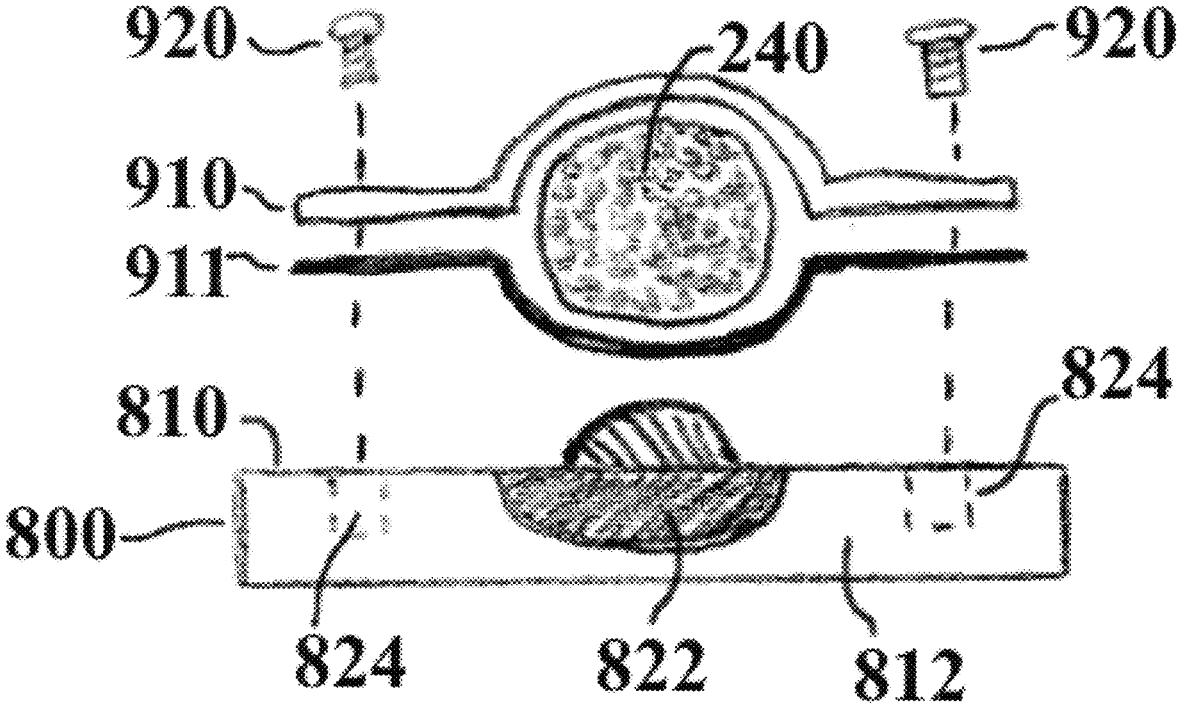
FIG. 14B is an exploded end elevational view of the male contact of FIG. 11.

Referring to FIGS. 14A and 14B, the cable attachment means is exemplified in a first crimp plate 910 and an optional second crimp plate 911 fixedly attached by two screws 920 to the crimp seats 722, 822 of each of the contacts 700, 800. The screws 920 pass through the first crimp plate 910 and tighten into the crimp locator holes 724, 824 in the respective contact 700, 800. Each electrical cable 140, 240 is held down between the respective crimp seat 722, 822 and first crimp plate 910. Both the first crimp plate 910 and the second crimp plate 911 are shown, but those skilled in the art will recognize that the second crimp plate 911 is optional. If the second crimp plate 911 is used, the second crimp plate 911 is positioned between the respective crimp seat 722, 822 and electrical cable 140, 240.

The female contact face 710 and the male contact face 810 are restrained in releasable engagement by the female housing 110 and the male housing 210, maintaining electrical connectivity between the first cable 140 and the second cable 240 while the male housing 210 remains fully inserted into the female housing 110.

It will be further understood that various changes in the details, materials, and arrangements of the parts which have been described and illustrated in order to explain the nature of this invention may be made by those skilled in the art without departing from the scope of the invention as expressed in the following claims.

I claim:

1. A smart breakaway electrical connector system comprising:

a. a female connector extending along a longitudinal axis and being fixedly connected at one end to a first electrical cable and having a second end with a cavity;

b. a male connector fixedly connected at a first end to a second electrical cable and having a second end adapted to be releasably inserted into the cavity in the second end of the female connector whereby electrical connectivity is established between the first electrical cable and the second electrical cable, the male connector further comprising a detent receiver located adjacent to the first end of the male connector, whereby the detent receiver is not covered when the male connector is inserted into the female connector;

c. means for monitoring the electrical connectivity between the first electrical cable and the second electrical cable, the means for monitoring comprising a controller configured to receive electrical information from the first electrical cable and a photovoltaic cell, electrically connected the controller, providing electrical power to the controller;

d. a wireless transmitter connected to the controller, the wireless transmitter configured to communicate a state of the electrical connectivity;

e. at least one locking arm having a first end pivotally connected to the female connector, and a second end having a detent adapted to releasably engage the detent receiver when the male connector is fully inserted into the female connector; and f. a biasing member releasably biasing the detent into the detent receiver.

2. The electrical connector according to claim 1, wherein the cavity in the second end of the female connector has at least one axial spline, and the second end of the male connector has a matching spline groove whereby the mated connectors are prevented from rotating around their longitudinal axis with respect to each other in response to torsion in the electrical cables.

3. The electrical connector according to claim 1, wherein the means for monitoring further comprises a rechargeable battery electrically connected to the controller, the controller being configured to use excess energy from the photovoltaic cell to charge the battery and to use energy from the photovoltaic cell and battery as available to control the monitoring means.

4. The electrical connector according to claim 3 wherein the wireless transmitter is electrically connected to the electrical controller, the controller being configured to provide power to the wireless transmitter.

5. A breakaway connector system comprising:

a. a female housing having a proximal end and a distal end, the female housing being formed in the shape of a hollow cylinder, wherein the female housing extends along a longitudinal axis, and wherein the female housing further comprises a threaded area formed circumferentially around an outer perimeter thereof, wherein the threaded area has a height and wherein the threaded area comprises at least one groove extending parallel to the longitudinal axis, wherein the groove has a depth exceeding the height of the threaded area;

b. a male housing having a proximal end shaped to releasably insert into the proximal end of the female housing, and a distal end having a detent receiver;

c. means for releasably holding the male housing inside the female housing up to a predetermined tensile load, wherein the means for releasably holding the male housing comprises at least one locking arm constructed from a flat spring having a pivot end pivotally connected to the female housing, the pivot end being located distal to the threaded area, and a second end being biased toward the connector when the locking arm is pivoted toward the proximal end of the female housing, whereby the second end engages the detent receiver on the male housing, wherein each locking arm extends along at least one respective groove such that each locking arm fits into its respective groove; and d. means for adjusting the predetermined tensile load, wherein the means for adjusting the predetermined tensile load comprises a first nut sized to thread onto the threaded area of the female connector while each locking arm is held down inside its respective groove, whereby the tightening of the nut toward the proximal end of the female housing biases the second end of the locking arm into the lip.

6. The breakaway connector system according to claim 1, wherein the means for adjusting the predetermined tensile load comprises a first nut sized to thread onto the threaded area of the female connector while each locking arm is held down inside its respective groove, whereby the tightening of the nut toward the proximal end of the female housing biases the second end of the locking arm into the lip.

7. The breakaway connector system according to claim 5, further comprising a second nut threaded onto the threaded section of the female housing, distal to the first nut, tightened up against first nut whereby the nuts are releasably locked against each other by friction.

8. The breakaway connector system according to claim 6, further comprising a spring guide sized to slide over the threaded area, with the spring guide having a tab for each locking arm, pointing in toward the connector and bent away from the first nut, each tab being shaped to fit partially into one of the respective grooves and engage the respective locking arm, whereby each locking arm is biased into its respective groove to prevent contact between the locking arm the nuts.

9. A breakaway electrical connector system comprising:

a. a female connector extending along a longitudinal axis and being fixedly connected at a first end to a first electrical cable and having a second end with a cavity;

b. a male connector fixedly connected at a first end to a second electrical cable and having a second end adapted to be releasably inserted into the cavity in the second end of the female connector, whereby electrical connectivity is established between the first electrical cable and the second electrical cable, the male connector further comprising a detent receiver located adjacent to the first end of the male connector, whereby the detent receiver is not covered when the male connector is inserted into the female connector;

c. at least one locking arm having a first end pivotally connected to the female connector, and a second end having a detent adapted to releasably engage the detent receiver when the male connector is fully inserted into the female connector; and d. a biasing member releasably biasing the detent into the detent receiver.

10. The breakaway electrical connector system according to claim 9, wherein the biasing member comprises a helical spring.

11. The breakaway electrical connector system according to claim 9, wherein the biasing member comprises a band.

12. The breakaway electrical connector system according to claim 9, further comprising a controller configured to receive electrical information from the first electrical cable and a photovoltaic cell, electrically connected to the controller, providing electrical power to the controller.

13. The breakaway electrical connector system according to claim 12, further comprising an amperage transducer electrically connected to one of the first electrical cable and the second electrical cable and to the controller, wherein the amperage transducer is configured to transmit an electrical signal to the controller when electrically connectivity between the first electrical cable and the second electrical cable is lost.

14. The breakaway electrical connector system according to claim 12, further comprising a wireless transmitter connected to the controller, the wireless transmitter configured to communicate a state of the electrical connectivity between the first electrical cable and the second electrical cable.

* * * * *